US009541268B2

(12) United States Patent
Clark

(10) Patent No.: US 9,541,268 B2
(45) Date of Patent: Jan. 10, 2017

(54) CEILING CLAMP FOR RECESSED LIGHT MOUNTING

(71) Applicant: ABL IP Holding LLC, Decatur, GA (US)

(72) Inventor: Stephen Howard Clark, Downers Grove, IL (US)

(73) Assignee: ABL IP Holding LLC, Decatur, GA (US)

( * ) Notice: Subject to any disclaimer, the term of this patent is extended or adjusted under 35 U.S.C. 154(b) by 93 days.

(21) Appl. No.: 14/605,258

(22) Filed: Jan. 26, 2015

(65) Prior Publication Data

US 2015/0219295 A1 Aug. 6, 2015

Related U.S. Application Data

(60) Provisional application No. 61/934,936, filed on Feb. 3, 2014.

(51) Int. Cl.

| | |
|---|---|
| ***F21V 15/00*** | (2015.01) |
| ***F21V 21/04*** | (2006.01) |
| ***F21S 8/02*** | (2006.01) |

(52) U.S. Cl.

CPC ..... *F21V 21/042* (2013.01); *F21S 8/026* (2013.01)

(58) Field of Classification Search

CPC ..... F21V 21/041–21/049; F21S 8/02; F21S 8/026

See application file for complete search history.

(56) References Cited

U.S. PATENT DOCUMENTS

| | | | | |
|---|---|---|---|---|
| 5,377,088 | A * | 12/1994 | Lecluze | F21V 21/04 248/343 |
| 7,618,167 | B2 | 11/2009 | Bedard | |
| 8,308,322 | B2 | 11/2012 | Santiago et al. | |
| 8,337,055 | B2 | 12/2012 | Clifton et al. | |
| 2005/0258326 | A1 * | 11/2005 | St-Pierre | F21V 21/04 248/316.7 |
| 2008/0186718 | A1 * | 8/2008 | Magisano | F21V 21/045 362/366 |
| 2009/0010007 | A1 | 1/2009 | Caluori | |

* cited by examiner

*Primary Examiner* — Thomas M Sember

(74) *Attorney, Agent, or Firm* — Kilpatrick Townsend & Stockton, LLP

(57) ABSTRACT

A lighting mount assembly and method are disclosed to mount a recessed light fixture in an opening in a wall. The lighting mount assembly includes a mounting frame, and at least two adjustable brackets which are movable relative to the mounting frame. The mounting frame and the brackets cooperate to clamp a portion of the wall from opposing sides. Each of the brackets also includes a resilient member, such as a leg spring, which can be engaged to and disengaged from a portion of a light fixture, such as a groove, to hold or release the recessed light fixture in the wall opening.

18 Claims, 8 Drawing Sheets

CEILING CLAMP FOR RECESSED LIGHT MOUNTING

RELATED CASES

The present application claims priority under 35 U.S.C. §119(e) based on U.S. Provisional Application Ser. No. 61/934,936 filed on Feb. 3, 2014, which is incorporated by reference herein in its entirety.

FIELD

The present disclosure is related to a lighting mount assembly for mounting a recessed light fixture onto a wall such as a ceiling, and more particularly to a lighting mount assembly that can accommodate varying wall thickness.

BACKGROUND

Recessed light fixtures are often used in commercial and residential buildings because they save space and are aesthetically pleasing, A recessed light fixture may include canister-type housing, also sometimes referred to as a can, to house a light source, reflector(s) and other lighting components, and an integral or separate trim. The recessed light fixture can be installed onto a ceiling, using various mounting assemblies such as bar hangars, screws or clips. However, the use of mounting assemblies, such as bar hangars, is limited by the space available behind the ceiling. Bar hangers typically are for new construction fixtures and are difficult to install into a finished ceiling unless there is a top access. Furthermore, the mounting assemblies may not be suitable for use with a range of different wall thicknesses.

SUMMARY

A lighting mount assembly and method are disclosed to facilitate installation and mounting of a recessed light fixture onto a ceiling through a ceiling opening. The lighting mount assembly includes a mounting frame, and at least two movably adjustable brackets which are movable relative to the mounting frame. Each bracket includes a flange on one end, and a resilient member, such as a spring leg(s). The resilient member is retained at a fixed distance from the flange on each bracket. The mounting frame and the flange of the brackets cooperate to clamp opposing sides of a portion of the ceiling through the ceiling opening, in order to secure the lighting mount assembly to the ceiling. The resilient member is configured to contact and hold a recessed light fixture, such as a canister-type housing (or "can"), in the ceiling opening.

The lighting mount assembly can be used to mount a recessed light fixture where space is limited behind a wall, such as where the use of typical bar hangers is difficult or impossible. The lighting mount assembly can also be installed from below the ceiling, which is useful in remodel type fixtures. Furthermore, the lighting mount assembly can accommodate a variety of ceiling thicknesses, while maintaining a fixed distance between the resilient member and an exterior side of the ceiling (e.g., a room side of the ceiling). For example, the fixed distance can be a specific height of the resilient member from the flange which rests against a bottom or room side of a ceiling. The lighting mount assembly also provides for a minimum or reduced below ceiling profile, which allows for easier concealment of the lighting mount assembly by aesthetic parts of the recessed light fixture. In addition, the lighting mount assembly also is particularly useful with small diameter recessed light fixtures, and uses minimal space above the ceiling opening to allow for better heat sink design and other mechanical considerations. This also means that the light source regression is at a fixed distance from the bottom surface of the ceiling. Therefore, the visual aesthetic and lighting performance of a fixture that uses the present lighting mount method and assembly are not affected by varying ceiling thicknesses.

In accordance with an exemplary embodiment, a lighting mount assembly includes a mounting frame, two movably adjustable brackets and a fastener for each bracket. The mounting frame includes a frame opening and two bracket supports with an overhang portion positioned over the frame opening. The mounting frame is arranged on a first side (e.g., a top) of the ceiling, with the frame opening positioned over the ceiling opening. Each bracket has a first end and an opposite second end. The first end of each bracket is movably connected to the overhang portion of one of the bracket supports of the mounting frame using one of the fasteners. Each of the brackets is movable relative to the mounting frame. The second end of the bracket includes a flange. The bracket further includes a resilient member, such as a spring leg, which is retained at a fixed distance from the flange. The resilient member is configured to engage a portion of a recessed light fixture, which is inserted through the ceiling opening and mounting frame during installation. Each of the brackets has a portion arranged in the wall opening adjacent to an interior surface of the ceiling, which defines the ceiling opening. In this example, the bracket and respective spring legs "float" along the length of the fastener, such as a bolt or screw. That is, the brackets can move freely between the overhang portion of the mounting frame and an end of the fastener, e.g., the head of the bolt or screw. To secure the lighting mount assembly to the ceiling, each of the brackets is movable to place a respective flange against an edge of a second side (e.g., a bottom or room side) of the ceiling around the ceiling opening. The fastener can then be tightened to clamp a portion of the ceiling through the ceiling opening between the mounting frame and the flange of each bracket.

To guide the movement of the bracket relative to the mounting frame, each bracket can also include a pair of grooved rails which are movably engaged to opposite edges of the bracket support of the mounting frame. The edges of the bracket support can extend along a length of the bracket support between a base of the mounting frame (with the frame opening) and the overhang portion.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

The present disclosure describes a lighting mount assembly for mounting a recessed light fixture onto a wall, such as a ceiling, floor, or other type of wall, through a wall opening. The lighting mount assembly employs an adjustable clamping system to secure the assembly onto the wall through the wall opening, and can accommodate varying wall thickness. Examples of the lighting mount assembly are described in greater detail below with reference to the figures.

Figure 1:
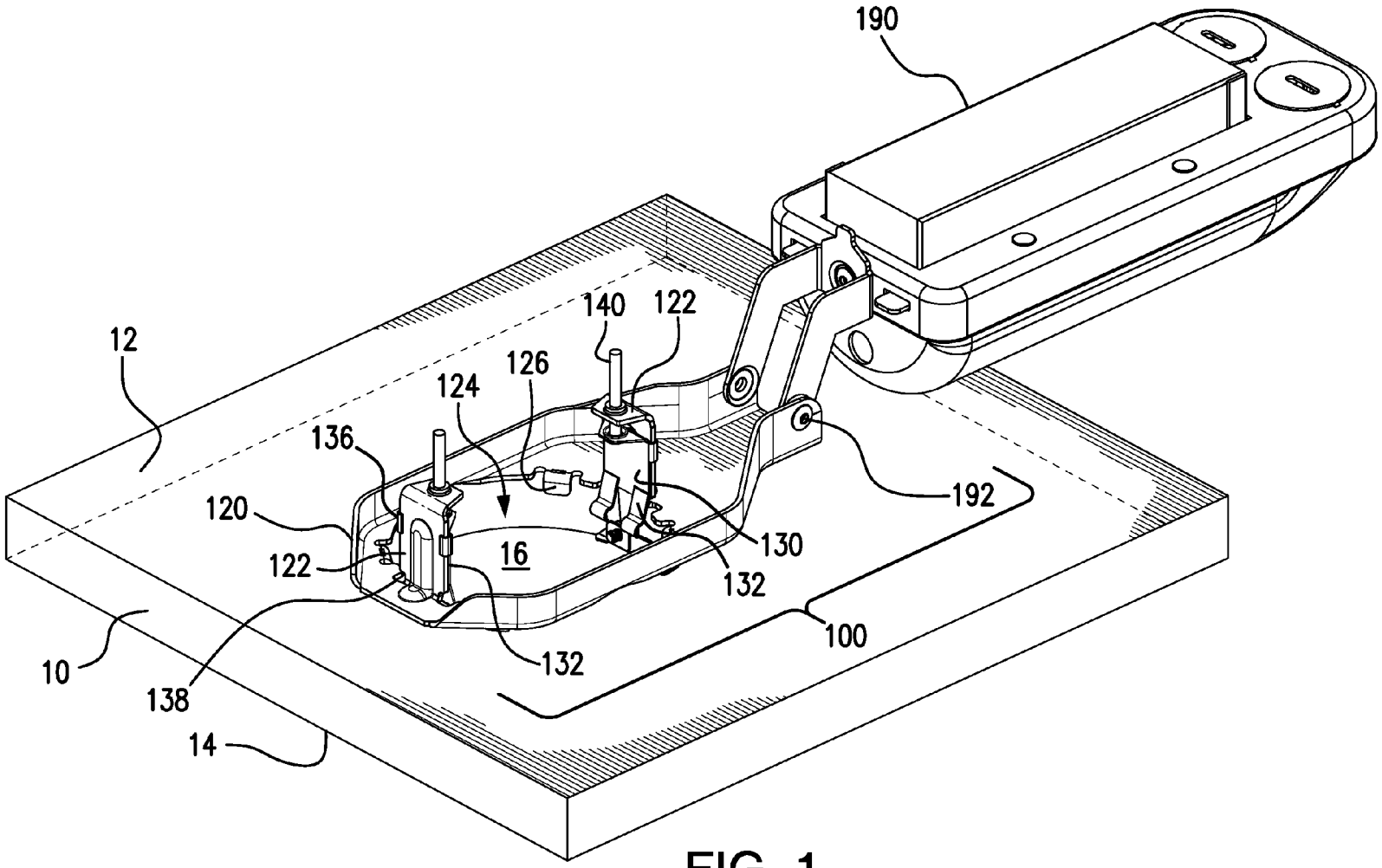
FIG. 1 illustrates a perspective view of a lighting mount assembly for mounting a recessed light fixture onto a wall in accordance with an exemplary embodiment of the present disclosure.

FIG. 1 illustrates a lighting mount assembly 100 for mounting a recessed light fixture onto a wall 10 through a wall opening 16, which extends from a first side 12 to an opposite second side 14. In this example, the first side 12 is an interior side of the wall 10, and the second side 14 is an exterior side of the wall 10, such as a room side of the wall. The lighting mount assembly 100 includes a mounting frame 120, at least two movably adjustable brackets 130 and a fastener 140 for each bracket 130. The mounting frame 120 can be pivotably connected to a junction box 190 at a hinge(s) 192.

Figure 2:
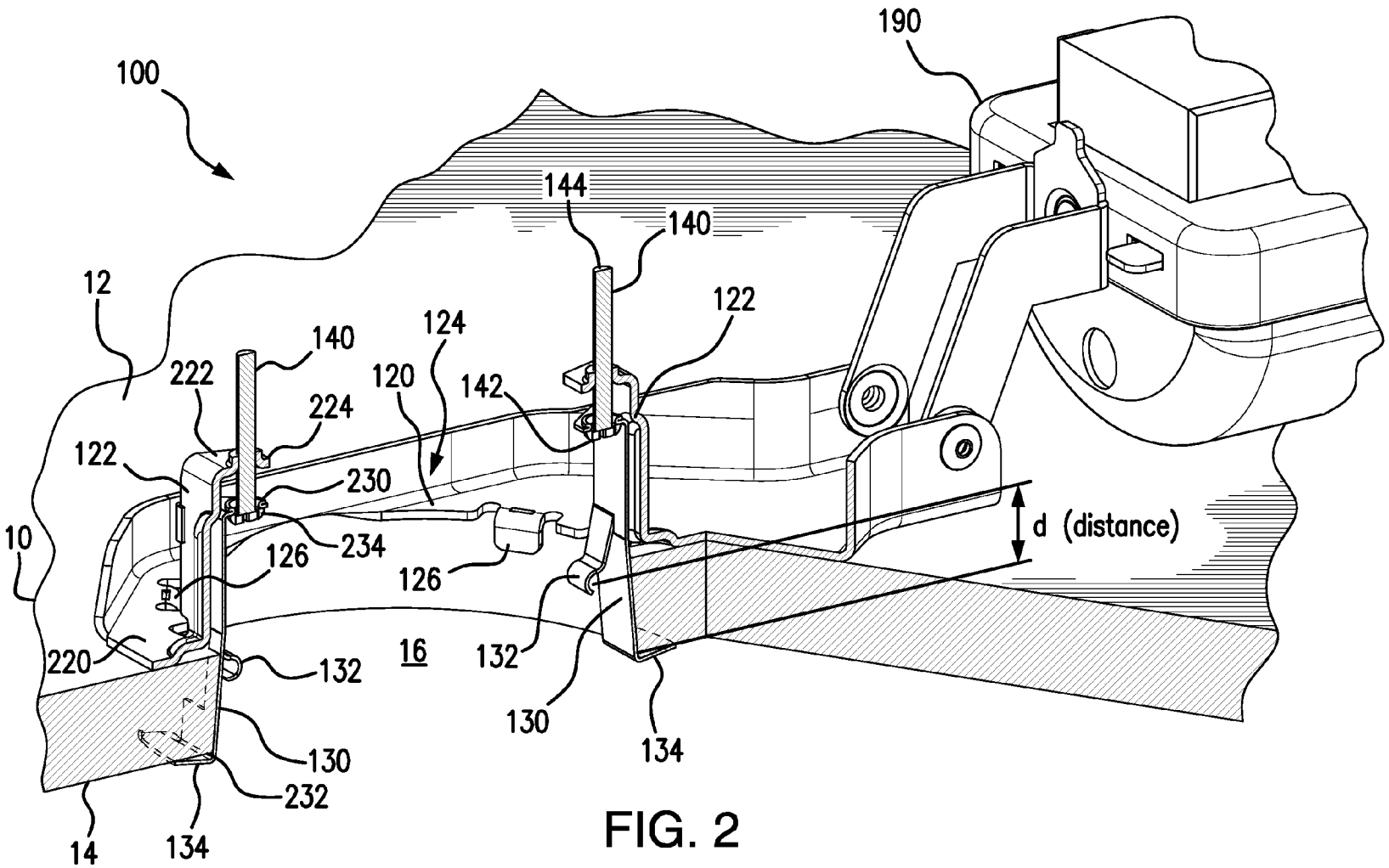
FIG. 2 illustrates a cross-sectional view of the lighting mount assembly of FIG. 1, which is secured onto a wall over a wall opening.
Figure 3:
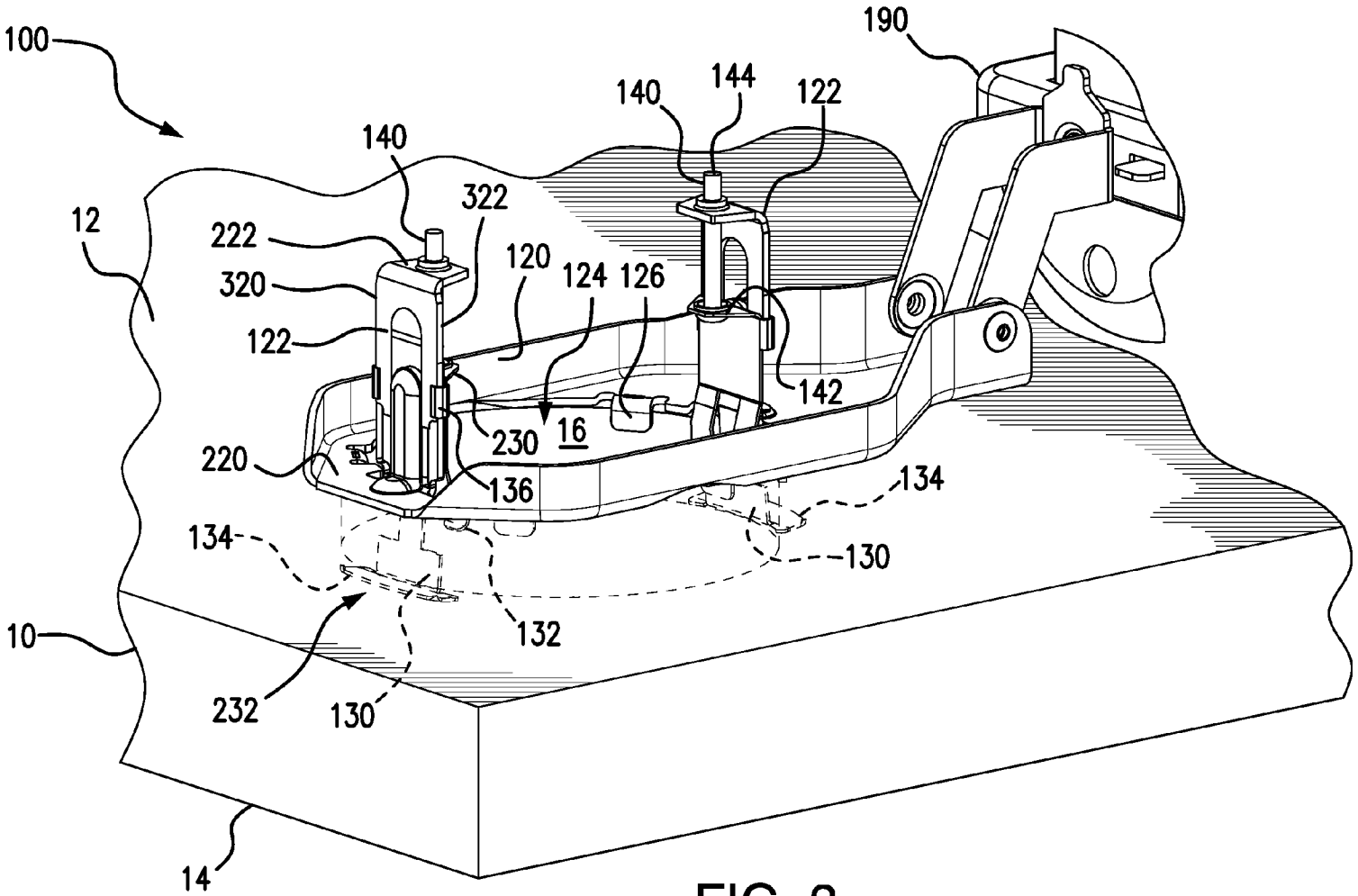
FIG. 3 illustrates another perspective view of the lighting mount assembly of FIG. 1 secured onto a wall, with the wall shown as transparent to provide a better view of the components of the lighting mount assembly.

As shown in FIGS. 2 and 3, the mounting frame 100 includes a frame opening 124 on a base 220, and two bracket supports 122 with an overhang portion 222 positioned over the frame opening 124. In this example, the two bracket supports 122 are positioned on opposite sides of the frame opening 124. Each of the bracket supports 122 extends substantially perpendicularly from the base 220, e.g., from a location around a periphery of the frame opening 124, toward the overhang portion 222. The overhang portion 222 includes a fastener hole 224 to receive a fastener, such as the fastener 140. Each bracket support 122 also includes opposing edges 320 and 322 (see e.g., FIG. 3) extending substantially along a length thereof between the base 220 and the overhang portion 222.

The mounting frame 120 is arranged on or adjacent to the first side 12 of the wall 10, with the frame opening 124 positioned over the wall opening 16. To facilitate and maintain alignment with the wall opening 16, the mounting frame 120 can also include one or more alignment tabs 126 that extend from the base 220 at various locations along a periphery of the frame opening 124. For example, the alignment tab 126 can extend substantially perpendicularly from the base 220, in an opposite direction than the bracket support 122. The alignment tab 126 is positioned within the wall opening 16 adjacent to an interior surface of the wall 10, which defines the wall opening 16.

Each bracket 130 has a first end 230 and an opposite second end 232. The first end 230 of each bracket 130 is movably connected to the overhang portion 222 of one of the bracket supports 122 of the mounting frame 120 using one of the fasteners 140. In this example, the first end 230 includes a fastener hole 234 for the fastener 140 such as a bolt or screw (hereinafter "bolt"). The bolt can include a bolt head 142 with a threaded shaft 144 extending therefrom. Starting from the bolt head 142, the bolt has the shaft 144 connected through the fastener hole 234 of the first end 230 of the bracket 130 and then through the fastener hole 224 on the overhang portion 222 of the bracket support 122. The bolt head 142 faces outward towards an area to be illuminated by the recessed lighting fixture. Each of the brackets 130 is movable relative to the mounting frame 120 by operating or manipulating a respective fastener 140. The second end 232 of the bracket 130 includes a flange 134. In this example, the flange 134 extends substantially perpendicularly from an end portion of the bracket 130.

Each of the brackets 130 further includes one or more resilient members 132. Each of the resilient members 132 is retained at a fixed distance (e.g., "d" in FIG. 2) from the flange 134. In this example, each bracket 130 has a pair of resilient members 132 on opposite sides of its fastener 140 (best seen in FIG. 1). Each free end of the resilient member 132 extends generally toward a middle or central axis of the frame opening 124. The resilient member 132 is configured to engage a portion of a recessed light fixture (e.g., a groove) when the recessed light fixture is inserted through the wall opening 16 and mounting frame 120 during installation. For example, the resilient member 132 can be a spring leg, with a free end portion which is bent at an acute angle to engage a portion of the recessed fixture. The bracket 130, including the resilient member(s) 132, can be formed of plastic, spring steel or other suitable types of known resilient materials, as a single or unitary piece.

Each of the brackets 130 has a portion thereof arranged in the wall opening 16 adjacent to an interior surface of the wall 10, which defines the ceiling opening 16. To guide the movement of the bracket 130 relative to the mounting frame 120, each bracket 130 can also include a pair of rails 136 which are movably engaged to the opposite edges 320 and 322 of the bracket support 122 of the mounting frame 120, as shown in FIG. 3. The edges 320 and 322 of the bracket support 122 can extend along a length of the bracket support 122 between the base 220 of the mounting frame 120 and the overhang portion 222. Accordingly, a portion of each bracket 130 can slide along a length of the bracket support 122, when moved using the fastener 140. In the base 220, there is a clearance slot 138. The clearance 138 simply allows the bracket 130 to be slid up the bracket support 122 from below.

For example, to secure the lighting mount assembly 100 to the wall 10, each of the brackets 130 is partially released from the bracket support 122 by loosening the fasteners 140. Each bracket 130 is then moved, to extend a portion of the bracket 130 through the wall opening 16. Each bracket 130 is moved, as necessary, to place a corresponding flange 134 against an edge of the second side 14 of the wall 10 around the wall opening 16. Tightening the fastener 140 forces the flange 134 against the exterior or second side 14 of the wall 10 thus clamping a portion of the wall 10 through the wall opening 16 between the base 220 of the mounting frame 120 and the flange 134 of each bracket 130. Accordingly, each bracket 130 can be moved relative to the mounting frame 120 to accommodate varying wall thicknesses, while retaining the fixed distance between the resilient member 132 and the flange 134.

In this example, the bracket 130 and respective resilient members 132 (e.g., spring legs) "float" along the length of the fastener 140, such as a bolt or screw. That is, each of the brackets 130 can move freely between the overhang portion 222 of the mounting frame 120 and an end of the fastener 140, e.g., the head of the bolt or screw. However, the bracket 130 can also be fixed to the fastener 140.

Figure 4:
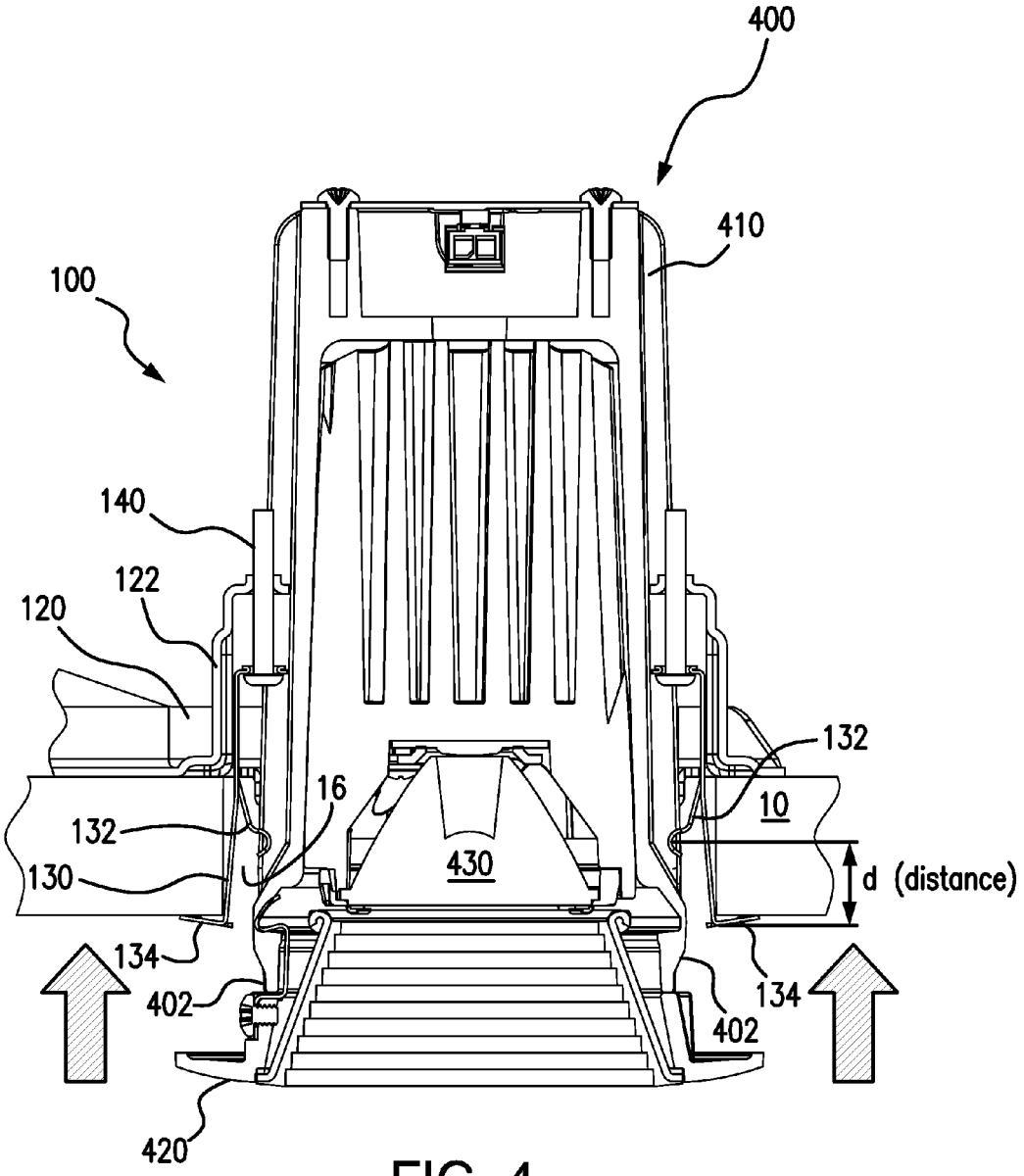
FIG. 4 illustrates a cross-sectional view of the lighting mount assembly of FIG. 1, which is secured over a wall opening, and of a recessed light fixture to be mounted onto the wall through the wall opening.
Figure 5:
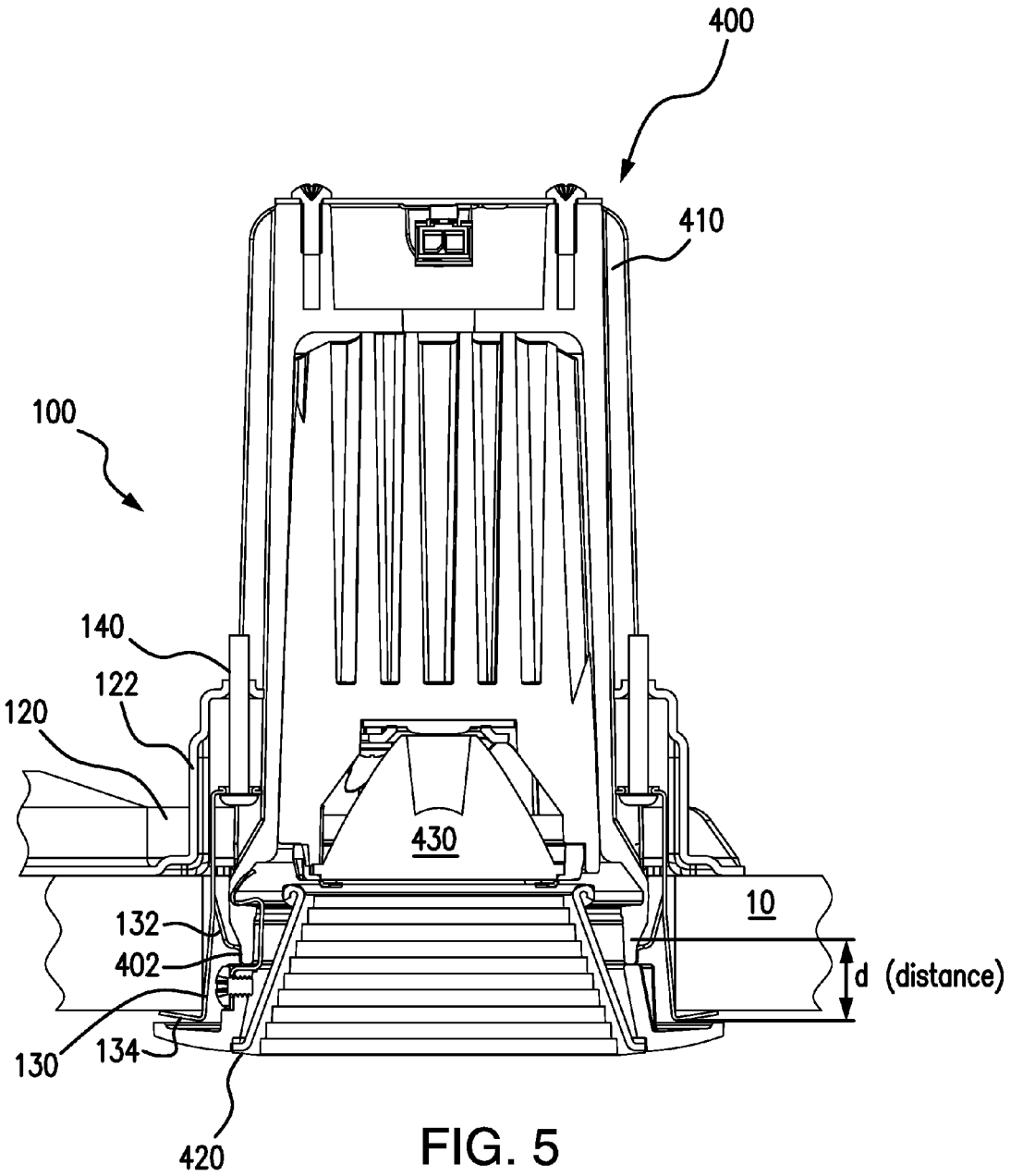
FIG. 5 illustrates a cross-sectional view of the lighting mount assembly of FIG. 1, which is secured over a ceiling opening, with the recessed light fixture of FIG. 4 mounted onto the wall through the wall opening.
Figure 6:
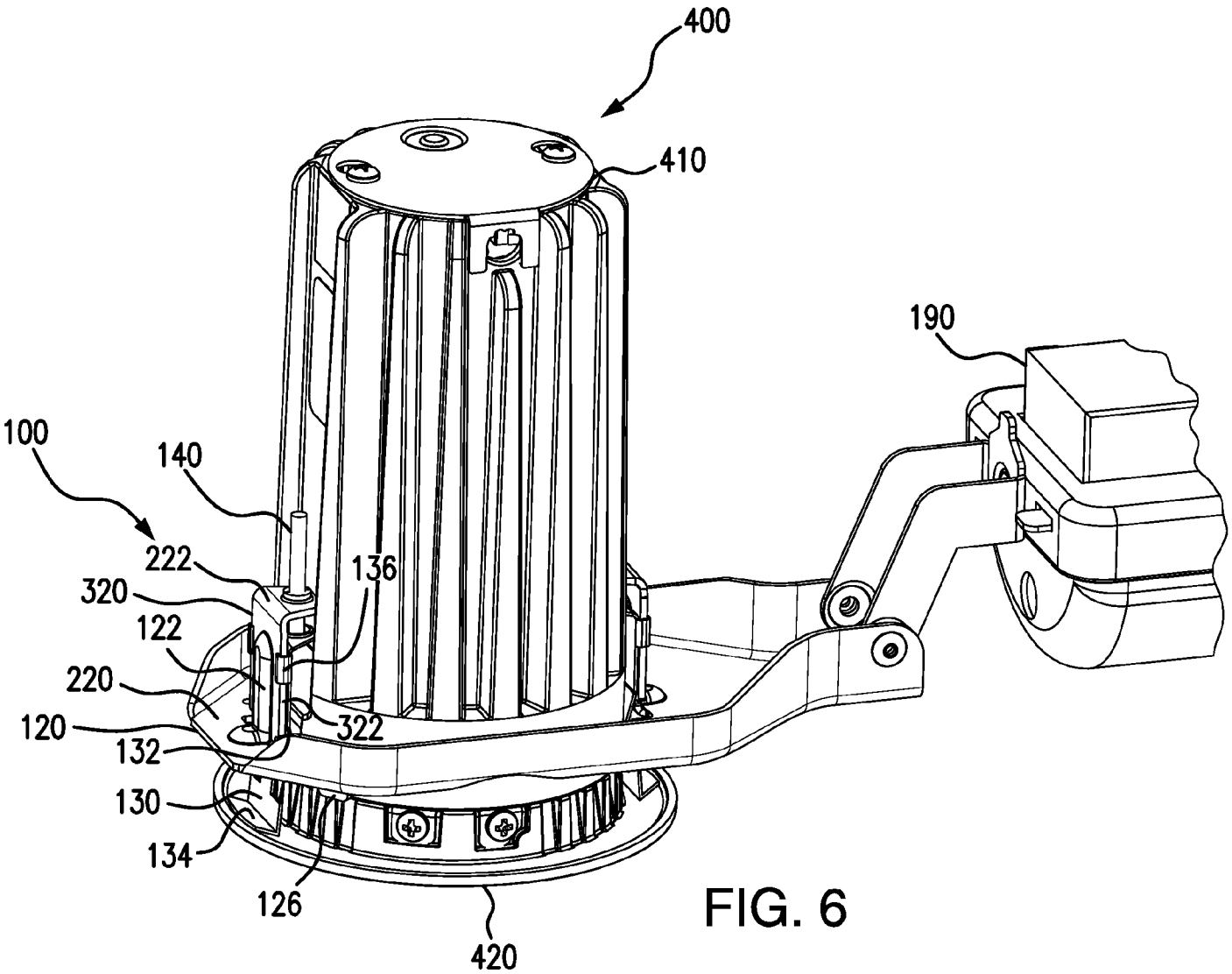
FIG. 6 illustrates a perspective view of the lighting mount assembly and recessed light fixture in FIG. 5, without the wall.

As shown in FIGS. 4-6, once the lighting mount assembly 100 is secured to the wall 10, a light fixture, such as a recessed light fixture 400, can be mounted onto the wall 10 in the wall opening 16. The recessed light fixture 400 is simply provided as one example of a canister-type recessed light fixture, which can be mounted using the light mounting assembly 100. In this example, the recessed light fixture 400 includes a housing 410 (e.g., an outer heat sink) and a trim 420 with a gimbal lighting 430 (e.g., a gimbal with a LED light source and optic(s)), which are pre-assembled as a single unit before installation onto the lighting mount assembly 100. The housing 410 can have a substantially cylindrical shape, with a cavity for housing various lighting components (e.g., gimbal assembly, light source, optics, etc.). The recessed light fixture 400 includes groove(s) 402. During installation, the recessed light fixture 400 is inserted through the wall opening 16 and the frame opening 124 (which is hidden by a portion of the light fixture 400 inserted therethrough) as shown in FIG. 4 until the resilient member 132 of each bracket 130 snaps into and engages the groove(s) 402 to contact and hold the recessed light fixture 400 as shown in FIG. 5. FIG. 6 illustrates a perspective view of the recessed light fixture 400 mounted to the lighting mount assembly 100. In FIG. 6, the wall 10 is removed to provide a better view of the various components of the lighting mount assembly 100 in relation to the recessed light fixture 400.

It should be understood that the lighting mount assembly 100 can be used with recessed light fixtures, other than the recessed light fixture 400, which have components that are separately assembled onto the wall 16 rather than as a single unit. Furthermore, the groove(s) of the recessed light fixture can also be located on different components of the fixture, such as the canister housing or the trim.

Figure 7:
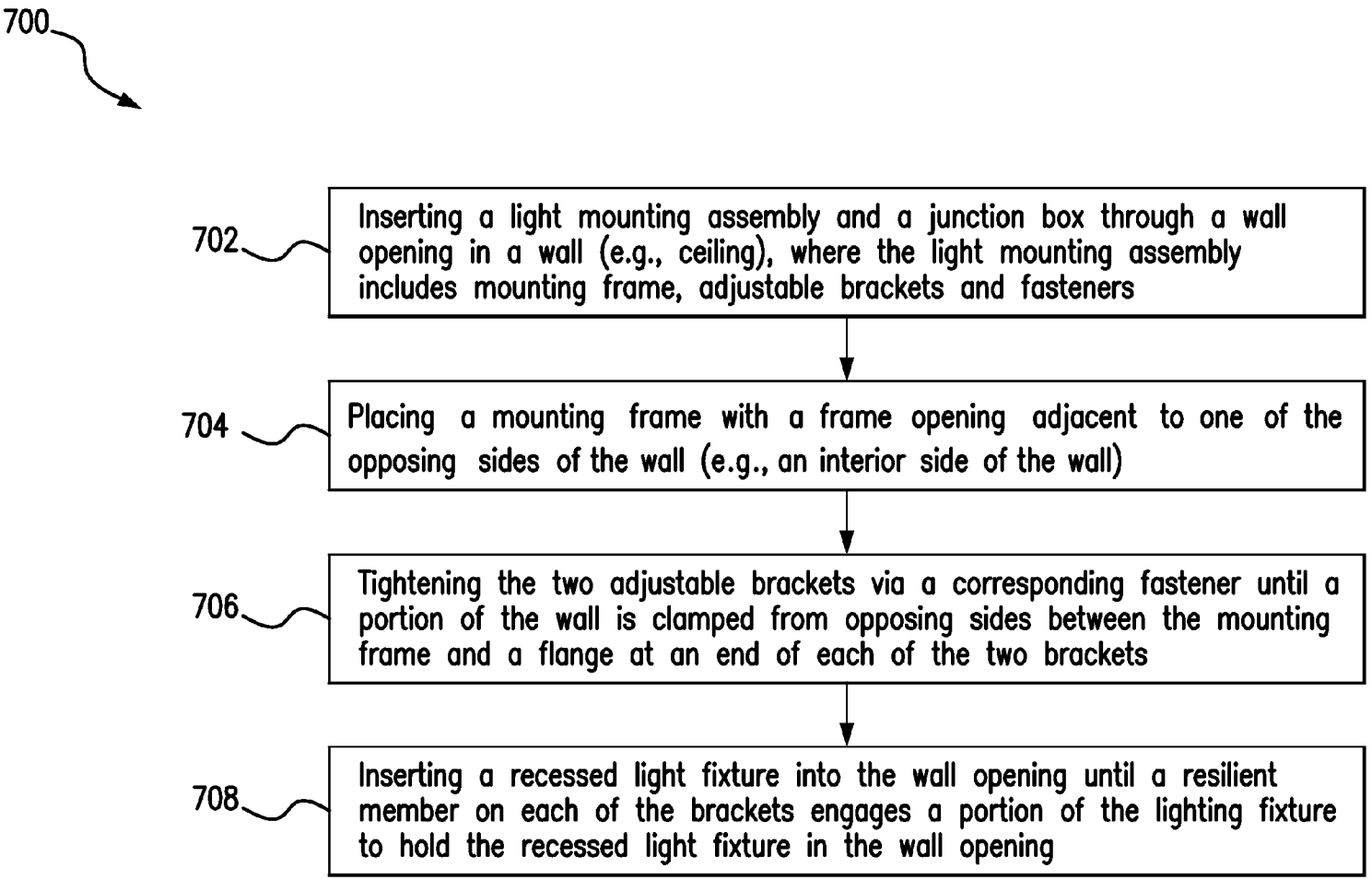
FIG. 7 illustrates an example process for mounting a light fixture onto a ceiling using the lighting mount assembly of FIG. 1.

FIG. 7 illustrates an example process 700 for mounting a light fixture onto a ceiling using the lighting mount assembly 100 of FIG. 1. For explanatory purposes, the process 700 will be described with reference to the various components of the lighting mount assembly 100 and the recessed light fixture 400 shown in FIGS. 1-6.

At reference 702, the lighting mount assembly 100 and the junction box 190 are inserted through the wall opening 16. The wall opening 16 can be a hole that is cut out in the wall 16 beforehand.

At reference 704, the mounting frame 120 is placed onto the first side 12 of the wall 10. The frame opening 124 is arranged over the wall opening 16, and aligned with the wall opening 16 with the alignment tabs 126. The brackets 130 are pulled down through the wall opening 16, and extend through the wall opening 16 so that their respective flanges 134 are arranged in relation or proximity to the second side 14 of the wall 10.

At reference 706, the brackets 130 are tightened via the fasteners 140 until a portion of the wall 10 is clamped from opposing sides between the mounting frame 120 and the flange 134 at an end of each of the two brackets 130. For example, the position of each bracket 130 is moved relative to the mounting frame 120, via a respective fastener 140, to place the flange 134 (e.g., at an end of each of the brackets 130) against the second side 14 of the wall 10, thereby clamping a portion of the wall 10 between the mounting frame 120 and the flange 134 of the brackets 130.

Once the light mounting assembly 100 is secured onto the wall 10, the recessed light fixture 400 can be inserted into the wall opening 16 until a resilient member(s) 132 on each of the brackets 130 engages a portion of the recessed lighting fixture 400 to contact and hold the recessed light fixture 400 in the wall opening 16, at reference 708. For example, the recessed light fixture 400 is inserted through the wall opening 16 and the frame opening 124, until the resilient member(s) 132 on each of the brackets 130 engages a portion of the recessed light fixture 400 to hold the recessed light fixture 400 in the wall opening 16. As previously discussed, the resilient member 132 snaps into and engages a groove(s) 402 on the recessed light fixture 400, to contact and hold the recessed light fixture 400 in the wall opening 16. The resilient member 132 can be disengaged, without the use of tools, from the groove(s) 402 to release the recessed light fixture 400 from the light mounting assembly 100 and thus the wall opening 116.

As previously discussed, the resilient member 132 of each of the brackets 130, e.g., spring leg, is retained at a fixed distance from a respective flange 134, and thus, from the second side 14 of the wall 10 (e.g., a bottom of the ceiling) regardless of the wall thickness. Such a configuration allows for consistent forces and geometry when the light fixture is assembled and installed in the wall opening 16. Furthermore, the flanges 134 of the brackets 130 can be configured to have minimal size and shape so the flanges 134 can be easily concealed by a trim of a recessed light fixture.

Figure 8:
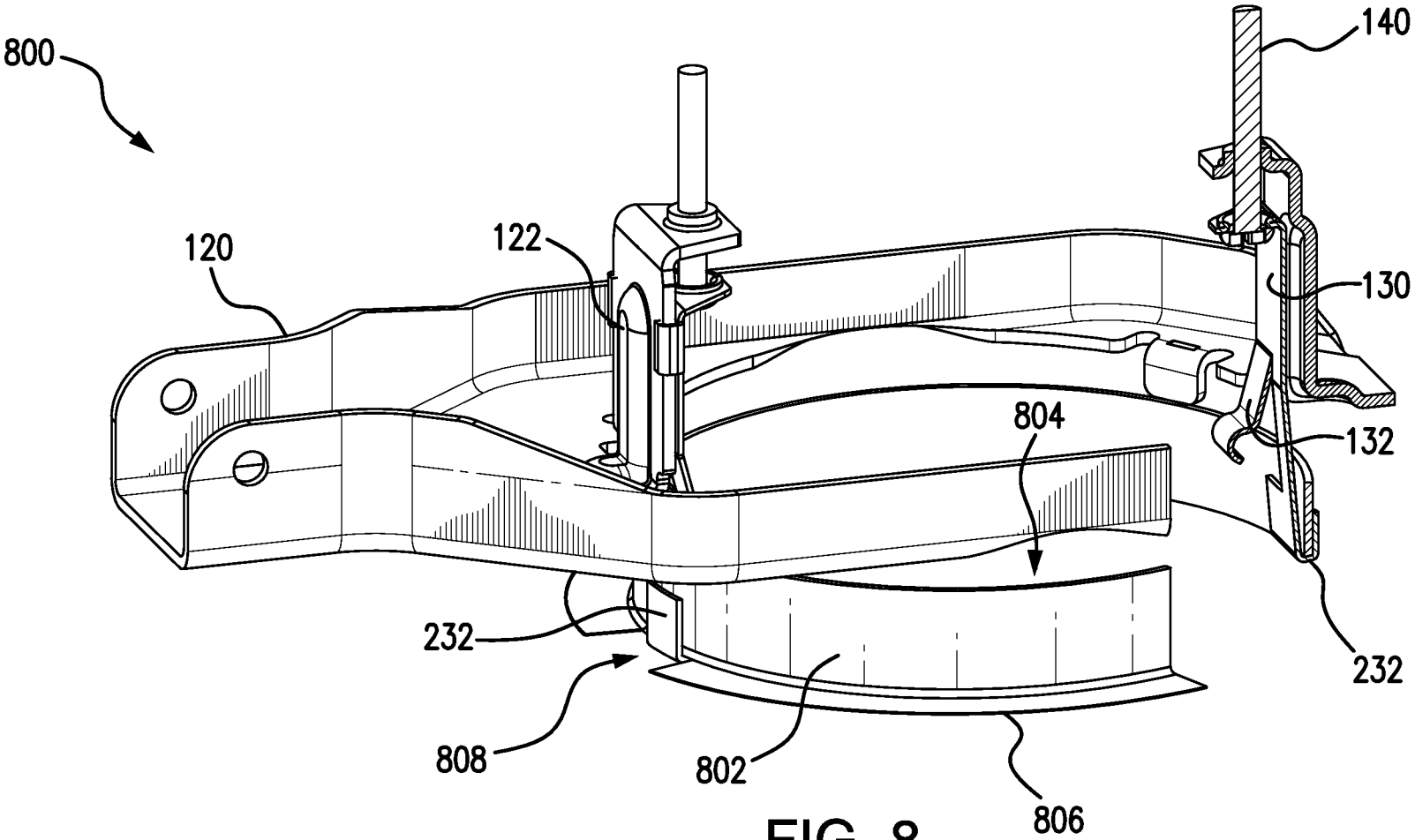
FIG. 8 illustrates a partial cross sectional view of a part of a lighting mount assembly for mounting a recessed light fixture onto a wall in accordance with another exemplary embodiment of the present disclosure.

FIG. 8 illustrates a lighting mount assembly 800, which is similar to the lighting mount assembly 100 as shown in FIGS. 1-6, in which the second end 232 of each bracket 130 is connected to or carries a flange used for clamping a portion of a wall. However, instead of forming or having a separate flange on the second end 232 of each bracket 130 (see e.g., FIGS. 1-6), the lighting mount assembly 800 employs a ring 802 (only partially shown) which is connected to the second end 232 of each bracket 130. The ring 802 has an opening 804 and a flange 806, which extends around the opening 804. The flange 806 extends outwards from one end of the ring 802. At least a portion of the flange 806 extends around the opening 804. In this example, the ring 802 is substantially cylindrical, and sized to fit in a wall opening. The flange 806 extends around the opening 804, and includes slots 808 for connecting respective second end 232 of each bracket 120 to the ring 802. As with the lighting mount assembly 100, the brackets 130 in the lighting mount assembly 800 can be tightened with respective fasteners 140 to clamp a portion of a wall between the mounting frame 120 and the flange 806 connected to the second end 232 of each bracket 130. Furthermore, the flange 806 also retains a fixed distance from the resilient member 132 of the brackets 130.

The lighting mount assemblies, as described herein, are provided as examples. The lighting mount assembly of the present disclosure can include more than two bracket supports, brackets, and fasteners. The fastener holes on the bracket supports and the brackets can be threaded to receive a threaded portion of a fastener, such as a bolt. The bracket can also be fixed to the fastener. Furthermore, each bracket can include one or more resilient members, e.g., springs, which can be configured in any suitable shape to snap into and engage a groove or the like on a recessed light fixture.

The lighting mount assembly can also use other types of fasteners than a bolt or screw or other types of springs that would clamp a light fixture to a wall. Although the resilient member (e.g., spring) is connected to the mounting frame, it is possible to have the resilient member arranged on the trim or lighting source of the light fixture, and to set the height of a ledge or lip on the light fixture for these to work against. The flange of each of the brackets can also be configured with different sizes and dimensions for clamping different wall thicknesses.

The lighting mount system and method can also be used for mounting other types of assemblies than light fixture (such as for example, a smoke detector, bathroom exhaust fan, junction box, or doorbell), where it is desirable to mount a first portion of an assembly behind a wall with a second portion that assembles through the wall into the first portion.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A lighting mount assembly for mounting a recessed light fixture onto a wall through a wall opening, the wall having a first side and an opposite second side, the lighting mount assembly comprising:

a mounting frame including a frame opening through which to receive a recessed light fixture, the mounting frame to be arranged on the first side of the wall; and two movably adjustable brackets to accommodate varying wall thicknesses, each of the brackets having a portion thereof to be arranged in the wall opening, each bracket including:

a resilient member to engage a portion of a recessed light fixture, a first end movably connected to the mounting frame to allow movement of the bracket relative to the mounting frame, and a second end opposite the first end, the second end having a flange that retains a fixed distance from the resilient member, each bracket being movable to position the flange against the second side of the wall to clamp a portion of the wall through the wall opening between the mounting frame and the flange.

2. The lighting mount assembly of claim 1, further comprising:

a fastener for each bracket, each fastener extending between the mounting frame and a respective bracket to connect the first end of the respective bracket to the mounting frame, each fastener being operable to tighten a portion of the bracket relative to the mounting frame thus clamping the portion of the wall.

3. The lighting mount assembly of claim 2, wherein the mounting frame includes a bracket support for each of the brackets, the bracket support having an overhang portion arranged over the frame opening to receive the fastener connected to one of the brackets.

4. The lighting mount assembly of claim 3, wherein the fastener is a bolt, and the overhang portion of the bracket support and the first end of the bracket both include a fastener hole to receive the bolt.

5. The lighting mount assembly of claim 4, wherein the fastener hole in the overhang portion is threaded.

6. The lighting mount assembly of claim 4, wherein the bolt includes a bolt head with a threaded shaft extending therefrom, the bolt head facing outward towards an area to be illuminated by the recessed light fixture.

7. The lighting mount assembly of claim 6, wherein the bracket floats along a length of a respective bolt between the overhang portion and the bolt head.

8. The lighting mount assembly of claim 3, wherein each of the brackets includes a grooved rail which is slidably engaged to an edge of a respective bracket support of the mounting frame.

9. The lighting mount assembly of claim 1, wherein the mounting frame includes an alignment tab arranged along a periphery of the frame opening.

10. The lighting mount assembly of claim 1, wherein the resilient member comprises a spring.

11. The lighting mount assembly of claim 10, wherein the spring comprises a spring leg.

12. The lighting mount assembly of claim 11, wherein each of the brackets includes a pair of the springs legs.

13. The lighting mount assembly of claim 1, wherein each of the brackets is formed as a unitary piece.

14. The lighting mount assembly of claim 1, wherein the first side of the wall is an interior side of the wall and the second side of the wall is an exterior side of the wall.

15. The lighting mount assembly of claim 1, wherein the mounting frame is connected to a junction box.

16. A lighting mount assembly for mounting a recessed light fixture onto a wall through a wall opening, the wall having a first side and an opposite second side, the lighting mount assembly comprising:

a mounting frame including a frame opening through which to receive a recessed light fixture, the mounting frame to be arranged on the first side of the wall; and a flange;

two movably adjustable brackets to accommodate varying wall thicknesses, each of the brackets having a portion thereof to be arranged in the wall opening, each bracket including:

a resilient member to engage a portion of a recessed light fixture, a first end movably connected to the mounting frame to allow movement of the bracket relative to the mounting frame, and a second end opposite the first end, the second end connected to the flange that retains a fixed distance from the resilient member, each bracket being movable to position the flange against the second side of the wall to clamp a portion of the wall through the wall opening between the mounting frame and the flange.

17. The lighting mount assembly of claim 16, wherein the flange comprises two separate flanges, each bracket having a respective one of the two separate flanges on the second end.

18. The lighting mount assembly of claim 16, further comprising a ring having an opening and the flange extending around a portion of the opening, the second end of the brackets being connected to the ring.

* * * * *